United States Patent [19]

Wood

[11] 3,995,384

[45] Dec. 7, 1976

[54] EDGE BIT STRUCTURE FOR IMPLEMENT BLADE

[75] Inventor: Jay J. Wood, Watsonville, Calif.

[73] Assignee: John F. Duncan, Castroville, Calif.

[22] Filed: Nov. 25, 1974

[21] Appl. No.: 526,743

[52] U.S. Cl. ..... 37/141 R; 37/141 T; 172/719; 172/753; 172/767; 172/777

[51] Int. Cl.[2] ..... E02F 9/28; A01B 35/26

[58] Field of Search ..... 37/141 R, 141 T, 142 R, 37/142 A; 172/719, 753, 762, 713, 777, 778, 767; 299/92, 91; 56/300; 214/145

[56] References Cited

UNITED STATES PATENTS

| | | | |
|---|---|---|---|
| 1,684,616 | 9/1928 | Bicek | 56/300 |
| 1,834,391 | 12/1931 | Edmunds | 37/142 R |
| 1,963,847 | 6/1934 | Jersey | 37/141 R |
| 2,052,521 | 8/1936 | Stires | 37/141 R |
| 2,204,718 | 6/1940 | Younie | 37/142 R |
| 2,339,128 | 1/1944 | Younie | 37/142 R |
| 2,732,639 | 1/1956 | Lillengreen | 37/141 R X |
| 3,029,534 | 4/1962 | Rakisits | 37/141 R |
| 3,456,370 | 7/1969 | Gilbertson | 37/141 R |
| 3,678,605 | 7/1972 | Prime | 37/141 T |
| 3,685,177 | 8/1972 | Hahn et al. | 37/141 R |
| 3,736,664 | 6/1973 | Black et al. | 37/141 R |
| 3,748,762 | 7/1973 | Tarrant | 37/141 T |
| 3,864,853 | 2/1975 | Klett et al. | 37/141 T |
| 3,879,867 | 4/1975 | Ericson et al. | 37/142 A |

FOREIGN PATENTS OR APPLICATIONS

| | | | |
|---|---|---|---|
| 2,114,498 | 10/1972 | Germany | 37/142 R |

*Primary Examiner*—Edgar S. Burr
*Assistant Examiner*—Steven A. Bratlie
*Attorney, Agent, or Firm*—John J. Leavitt

[57] ABSTRACT

A replaceable edge bit structure for a blade- or bucket type earthworking implement includes a bit having a pair of underbeveled catch regions in one of its faces. One of the regions has a configuration complementing that of the working edge of the implement's moldboard; the other region has a configuration complementing portions of mounting parts for the bit which are secured to the moldboard. The bit is removably held in conjoint engagement with the moldboard and mounting parts by a single pin disposed in front of and parallel to the moldboard, engaging the bit and mounting parts.

7 Claims, 3 Drawing Figures

EDGE BIT STRUCTURE FOR IMPLEMENT BLADE

BACKGROUND AND OBJECTS OF THE INVENTION

The present invention concerns power operated earthworking equipment, and relates in particular to an improved replaceable edge bit structure for an earthworking implement's blade or bucket.

Blade- or bucket-type earthworking implements, such as road graders, bulldozers, bucket loaders, and the like, are commonly provided with replaceable wear-absorbing members, or bits, along the working edge of the implement's moldboard. Prior art edge bit structures are shown, for example, in U.S. Pat. Nos. 3,152,411, issued Oct. 13, 1964, and 3,469,331, issued Sept. 30, 1969, to the applicant herein.

Present replaceable edge bits typically take the form of plate-like elements fastened directly to the front or working face of an implement's moldboard along its lower or working edge, or to a mounting plate secured to the face of the moldboard. However, the working edge of the moldboard is left unprotected, and thus exposed to wear or damage, partially defeating the purpose of providing, replaceable, wear-absorbing edge bit members. Moreover, since the bits and/or their mounting members engage only the front face of the moldboard, forward directed stresses, e.g., those produced by dragging an implement's blade backward, tend to force the edge bits or mounting plates away from the moldboard, eventually loosening the bits and/or breaking the bolts or pins fastening them to the moldboard.

Replaceable edge bits conventionally are fastened to an implement's moldboard with a plurality of bolts or anchor pins extending through each bit and adjacent portions of the moldboard. Besides making edge bit replacement slow and inconvenient, particularly when the fasteners have become damaged or rusted in use, numerous holes must be drilled along the working edge of the moldboard, weakening it in that area.

A general object of the present invention is to provide an improved replaceable edge bit structure which overcomes these and other drawbacks of prior art structures.

A more specific object of the invention is to provide a replaceable edge bit structure for mounting on an earthworking implement's moldboard with a portion of the bit embracing, and thus covering and protecting, the moldboard's working edge.

A still more specific object of the invention is to provide a replaceable edge bit structure, including a bit having multiple catch regions therein, for mounting on an earthworking implement's moldboard by securing mounting parts having undercut marginal portions to the moldboard's working face, adjacent its working edge, then releasably securing the bit to the mounting part and moldboard with the catch regions in the bit in embracing, interfitted engagement with the undercut portions of the mounting parts and conjointly with the moldboard's working edge.

Stated another way, a still more specific object of the invention is to provide a replaceable edge bit structure or assembly for mounting on an earthworking implement's moldboard, the edge bit structure or assembly including an edge bit having multiple catch or receptor regions or sockets therein formed on one side thereof by projecting undercut or beveled portions of the edge bit, and edge bit mounting parts or strips secured to the working face of the moldboard adjacent its working edge and having undercut or beveled marginal portions so that certain catch or receptor regions or sockets in the edge bit may be releasably interengaged with or embrace the mounting strips while another catch or receptor region or socket in the edge bit may be releasably engaged with or embrace the working edge of the moldboard whereby the catch or receptor regions or sockets in the edge bit embrace the mounting strips and working edge of the moldboard in such a way as to prevent wear thereof.

Another object of the invention is to provide an edge bit for releasable attachment to the working edge of the moldboard of an earthworking implement and which cooperates with the moldboard to present a substantially smooth undersurface.

Another object of the invention is to provide a novel edge bit structure in which the bit is secured in place on an earthworking implement's moldboard by a single fastener, accessible from the front or working face of the moldboard.

Still another object of the invention is to provide novel means for mounting a replaceable edge bit on an implement's moldboard without the need for providing holes or other openings in the moldboard or projections therebelow.

A further object of the invention is to provide an improved edge bit which is economical to manufacture, simple to install, and which can be replaced quickly and without difficulty from the front side of an implement's moldboard using ordinary tools.

BRIEF DESCRIPTION OF THE DRAWINGS

The foregoing and other objects and advantages of the invention will become apparent from a reading of the following detailed description in conjunction with the accompanying drawings, wherein.

DETAILED DESCRIPTION

Figure 1:
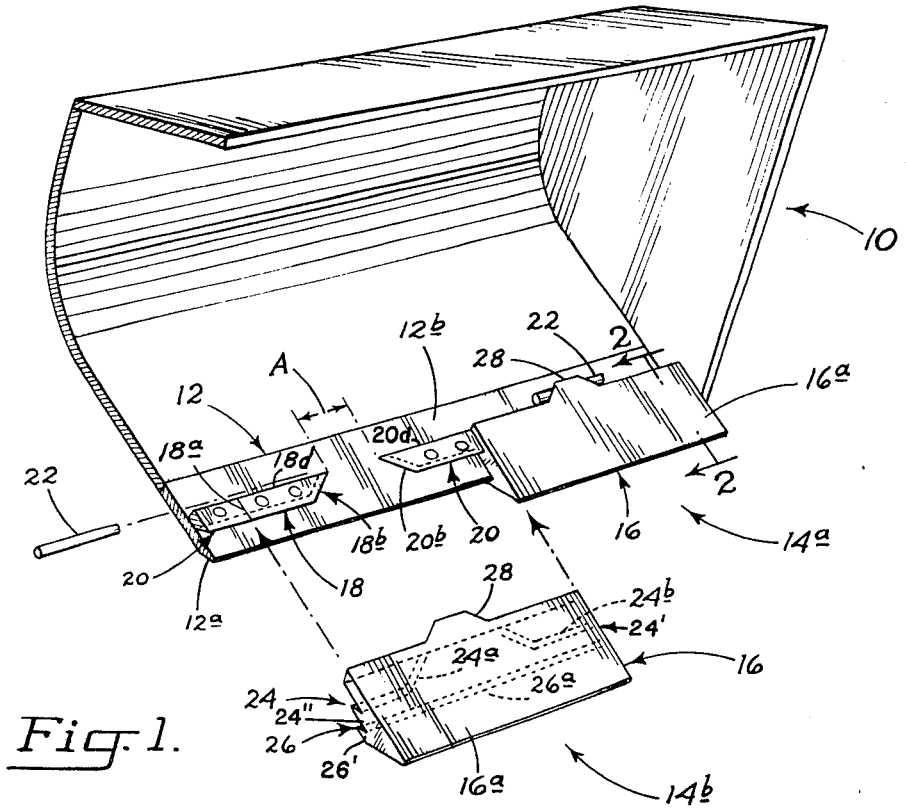
FIG. 1 is a fragmentary, perspective, partially exploded view of a loader bucket provided with the improved replaceable edge bit structures of the present invention.

Referring now to the drawings, there is shown in FIG. 1, in simplified form, a portion of a conventional loader bucket 10. Bucket 10 includes a reinforced moldboard 12 having a beveled lower or work-engaging edge **12*a*. Mounted on the moldboard in end-to-end relationship in the unique manner to be described are a plurality of the edge bit structures 14, each including a replaceable bit 16 having a beveled working edge as shown which joins the front working face 16*a* of the edge bit with the rear or moldboard facing side thereof, a pair of mounting parts 18, 20, and a retaining pin 22. Two complete such structures 14*a*, 14*b* are shown in the figure, the latter in exploded form to better illustrate the method of mounting. It will be understood, however, that a sufficient number of edge bit structures 14** are provided to extend substantially the entire length of the bucket's moldboard.

Figure 2:
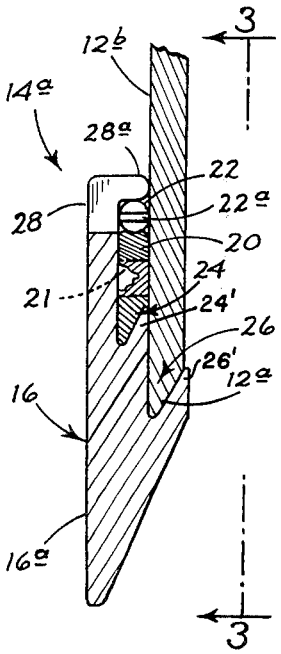
FIG. 2 is an enlarged, fragmentary sectional view taken along line 2—2 of FIG. 1, and showing the bucket's moldboard with the improved edge bit structure of the invention mounted thereon.
Figure 3:
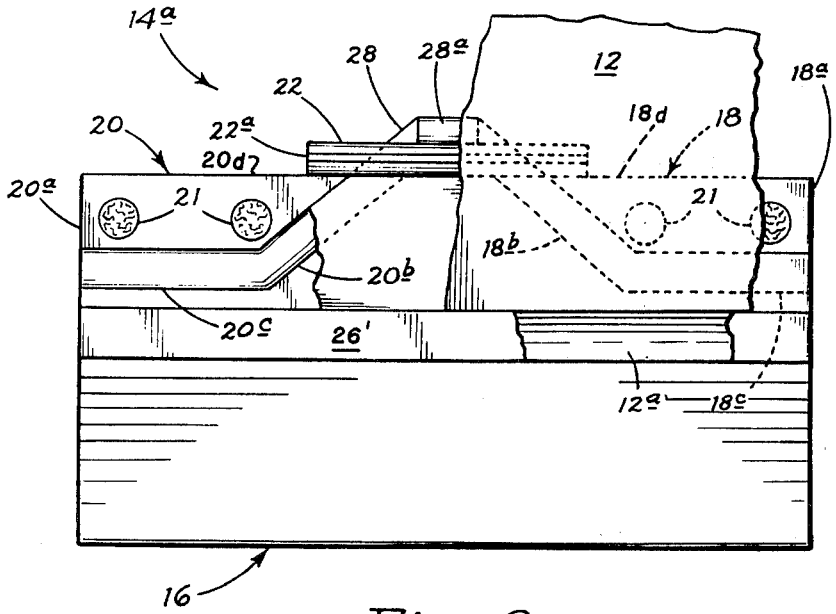
FIG. 3 is an enlarged, fragmentary rear or bottom view looking in the direction of arrows 3—3 of FIG. 2, with portions of the edge bit and moldboard broken away to disclose the interengagement or embracing relationship of the parts.

Now considering an individual edge bit structure 14 in greater detail, and referring to FIGS. 1, 2 and 3, bit mounting parts 18, 20 are flat, pointed, metal strips having essentially identical but opposite, or mirror-image, configurations. As best shown in FIG. 3, the mounting parts or strips have a trapezoidal shape, each including a squared-off end 18*a*, 20*a*, an opposite angular, underbeveled end 18*b*, 20*b* and an underbeveled lower edge 18*c*, 20*c* parallel in its long dimension with upper edges 18*d* and 20*d*. A pair of holes 21 is provided in each mounting part to accommodate means, suitably plug welds, securing the mounting part to moldboard 12. Parts 18, 20 are secured to the front face 12*b* of moldboard 12 in spaced, parallel relation with its lower edge 12*a*, mutually aligned and horizontally spaced-apart a suitable distance A (FIG. 1). Thus disposd, their opposing angular underbeveled ends 18*b*, 20*b* define an upward converging opening having underbeveled converging sides forward of the moldboard's front face 12*b*.

Replaceable edge bit 16 is a unitary member, preferably cast from a high grade alloy steel. As shown in FIG. 2, bit 16 has a generally wedge-shaped vertical cross section and a flat, substantially rectangular forward or working face 16*a*. Provided on the rear or moldboard-facing side of the bit are a pair of horizontally spaced-apart undercut catch or receptor regions or sockets 24 and 24' formed by undercut or beveled projections 24'' integral with the edge bit for engaging the complementarily undercut or beveled marginal portions of mounting parts 18, 20. Also provided on the rear or moldboard-facing side of the bit is an elongated undercut catch or receptor region or socket 26 vertically spaced from the foregoing pair of such receptor regions and formed by an elongated undercut or beveled projection or rib 26' integral with the edge bit and complementary in configuration to the beveled working edge 12*a* of the moldboard and adapted to receive the working edge 12*a* therewithin. Catch or receptor regions or sockets 24 and 24' each include a pair of angular grooves 24*a*, 24*b* having configurations complementing those of the undercut portions, i.e., ends 18*b* 20 *b* and edges 18*c*, 20*c*, of mounting parts 18, 20 respectively. Catch or receptor region or socket 26 comprises a single groove 26*a* having a configuration complementary to that of the moldboard's lower edge 12*a*. As will be understood, catch regions or grooves 24, 24' and 26 are disposed relative to one another in bit 16 to enable closely interfitted, conjoint engagement of each region or groove with its respective portion of the mounting parts and moldboard, as shown in FIG. 2.

Disposed centrally of the upper edge of bit 16, and extending upwardly therefrom in a general trapezoidal configuration is a tongue 28 having a rearwardly directed projection or lip 28*a*. Tongue 28 is sized to fit snugly as shown through the previously mentioned opening between ends 18*b*, 20*b* of the mounting parts, and, together with portions of the parts' upper edges 18*d* and 20*d* and lip 28*a* and face 12*b* of the moldboard, forms a passageway accommodating retaining pin 22. Pin 22 suitably is a steel flex pin, a known pinning device having a resilient central layer or core 22*a*. Driven into the just-described passageway, the pin resiliently urges tongue 28 and mounting parts 18, 20 in opposite directions, securely holding bit 16 in place on moldboard 12.

In the practice of the invention, a plurality of mounting parts 18, 20 are attached to an earthworking implement's moldboard in aligned relation, parallel to and spaced a suitable distance upwardly from the moldboard's working edge. As shown in FIG. 1, the mounting parts for one edge bit are disposed with their squared-off ends 18*a*, 20*a* abutting the mounting parts for adjacent bits. The mounting parts are preferably permanently anchored to the moldboard with plug welds in holes 21, thus avoiding the need to drill mounting holes in the moldboard. If desired, however, parts 18, 20 may be attached using bolts or pins extending through holes in the moldboard aligned with holes 21.

With mounting parts 18, 20 secured to moldboard 12, replaceable edge bit members 16 are seated against the moldboard and mounting parts with catch or receptor regions or grooves 24 and 24' in each bit embracing the ledges defined by undercut marginal portions 18*b*, 20*b*, 18*c*, 20*c* of the mounting parts. Conjointly, catch or receptor region or groove 26 embraces beveled edge 12*a* of the moldboard. With an edge bit thus in position, a pin 22 is driven into place under tongue 28, engaging the tongue and lip and the upper edges 18*d* and 20*d* of mounting parts 18, 20 and urging them in opposite directions. A closely interfitted or interlocked engagement results between the respective undercut or underbeveled portions of the bit, mounting parts, and moldboard, providing an extremely strong, secure mounting of the bit which resists both forward- and rearward-directed forces. In addition, lateral displacement of the bit is resisted by wedging of the undercut or beveled opposite sides of the trapezoidal tongue 28 into the opening between ends 18*b*, 20*b* of the mounting parts.

An earthworking implement provided with the replaceable edge bit structures of the invention is used in the customary manner until bits 16 are worn to such an extent that their lower or working edges are nearly flush with the working edge of the moldboard. The bits should, however, be replaced before the moldboard's lower edge is exposed to wear or damage. Because only a single, relatively inexpensive flex pin is used to secure each edge bit in place on the moldboard, and since the pin can be driven out from the front of the moldboard, replacement is fast and convenient, and can be easily accomplished in the field by the implement's operator. In the disclosed construction, the bit's mounting parts are almost completely covered by the bit, and thus are protected from damage or wear, and should seldom, if ever, require replacement.

Although a preferred embodiment of the invention has been described herein, it will be understood that various changes and modifications may be made without departing from the spirit of the invention.

It is claimed and desired to protect by Letters Patent:

1. A replaceable edge bit assembly for use with the moldboard of an earthworking implement, said moldboard including a front face and a working edge, comprising:

bit mounting means securable to and projecting upwardly from the front face of the moldboard, said bit mounting means including a pair of separate, horizontally spaced mounting parts spaced from and in parallel relation with the working edge, each said mounting part having an underbeveled lower edge which, when said mounting parts are secured to the front face of the moldboard, cooperates with the front face of the moldboard to define a groove opening in the direction of the working edge;

a replaceable edge bit including a first pair of receptor regions having a first pair of angular grooves complementary in configuration to the underbeveled lower edges of said mounting parts, and including a second receptor region spaced from said first pair of receptor regions and having a second groove complementary in configuration to the working edge of said moldboard, said receptor regions releasably engaging said mounting parts and releasably engaging and covering the working edge of the moldboard;

a retaining pin; and securing means on said edge bit adapted to cooperate with said mounting parts to receive said retaining pin and thereby releasably lock said edge bit to said moldboard.

2. A replaceable edge bit assembly as defined in claim 1, wherein said securing means comprises a tongue which extends between said spaced mounting parts, said retaining pin, releasably engaging said tongue and the sides of said mounting parts opposite the working edge of the moldboard in a wedging relationship and urging them in opposite directions to thereby hold the edge bit releasably locked to the moldboard when assembled.

3. The replaceable edge bit assembly of claim 2, wherein said second groove in said edge bit is shaped to interlockingly embrace the working edge of said moldboard without substantially projecting below said moldboard.

4. The replaceable edge bit assembly of claim 2, wherein said tongue extends away from said working edge and beyond said mounting parts, said retaining pin releasably engaging the portion of the tongue projecting beyond said mounting parts to urge said edge bit into engagement with said working edge and said mounting parts.

5. The replaceable edge bit assembly as defined in claim 1, wherein the adjacent ends of said pair of mounting parts are angular to form an upwardly converging opening therebetween, said angular ends being underbeveled, and wherein said first pair of angular grooves in said first pair of receptor regions are complementary to and adapted to engage said underbeveled angular ends to resist lateral movement of said edge bit.

6. The replaceable edge bit assembly as defined in claim 5, wherein said securing means comprises a trapezoidal tongue which extends between and beyond the angular ends of said spaced mounting parts, and wherein said retaining pin releasably engages the portion of the tongue projecting beyond said mounting parts and the sides of said mounting parts opposite the working edge of the moldboard in a wedging relationship to urge them in opposite directions to thereby hold the edge bit releasably locked to the moldboard when assembled.

7. The replaceable edge bit assembly as defined in claim 6, wherein said retaining pin is a flex pin to resiliently urge said edge bit into assembled relationship with said moldboard.

* * * * *